United States Patent [19]

Soma

[11] Patent Number: 4,671,596

[45] Date of Patent: Jun. 9, 1987

[54] METHOD OF PRESS-CONNECTING MULTICORE FLAT CABLE AND ELECTRIC CONNECTOR FOR MULTICORE FLAT CABLE

[75] Inventor: Keiji Soma, Tokyo, Japan

[73] Assignee: Hirose Electric Co., Ltd., Tokyo, Japan

[21] Appl. No.: 775,238

[22] Filed: Sep. 12, 1985

[30] Foreign Application Priority Data

Apr. 24, 1985 [JP] Japan ..... 60-88344

[51] Int. Cl.[4] ..... H01R 4/24; H01R 9/07

[52] U.S. Cl. ..... 439/404

[58] Field of Search ..... 339/97 R, 97 P, 98, 339/99 R

[56] References Cited

U.S. PATENT DOCUMENTS

| | | | |
|---|---|---|---|
| 4,099,822 | 7/1978 | Carlisle et al. | 339/98 |
| 4,127,312 | 11/1978 | Fleischhacker et al. | 339/99 R |
| 4,296,989 | 10/1981 | Larson et al. | 339/99 R |
| 4,323,295 | 4/1982 | Davis, Jr. | 339/107 |
| 4,537,455 | 8/1985 | Vertenten et al. | 339/99 R |
| 4,585,284 | 4/1986 | Koser et al. | 339/91 R |

FOREIGN PATENT DOCUMENTS 5753629 4/1980 Japan .

*Primary Examiner*—Gil Weidenfeld
*Assistant Examiner*—Gary F. Paumen
*Attorney, Agent, or Firm*—Fleit, Jacobson, Cohn & Price

[57] ABSTRACT

An electric connector for a multicore flat cable comprises an insulating housing which has a contact arrayal surface with a plurality of press-connecting type contacts disposed at a predetermined pitch so as to protrude their press-connecting portions therefrom, and a cable wiring member which is assembled to the contact arrayal surface of the insulating housing. The cable wiring member is provided with a plurality of core wire laying slots which are formed along a periphery thereof at intervals corresponding to the predetermined pitch, and a plurality of press-connecting portion receiving flutes which are formed so as to traverse the respective core wire laying slots and which receive the press-connecting portions of the respective contacts. Each core wire laying slot receives the corresponding one of core wires disjointed at an intermediate part of the multicore flat cable so that the corresponding core wire may surround the cable wiring member.

2 Claims, 6 Drawing Figures

METHOD OF PRESS-CONNECTING MULTICORE FLAT CABLE AND ELECTRIC CONNECTOR FOR MULTICORE FLAT CABLE

BACKGROUND OF THE INVENTION

1. Field of the Invention

This invention relates to a method of press-connecting a multicore flat cable and an electric connector for a multicore flat cable, and more particularly to such a press-connecting method and such an electric connector suitable for a high density multicore cable.

2. Description of the Prior Art

In recent electronic equipment, reductions in weight, thickness, length and size have been promoted, and high density packaging has been needed therefor. Accordingly, a miniaturized electric connector in which contacts are arrayed at the highest possible density has been required as an electric connector for use in the electronic equipment, and a multicore flat cable or the like in which a large number of core wires are arrayed at high density has been required as a cable to be used. In order to meet such requirements, there has hitherto been developed a high density multicore flat cable in which core wires are arrayed at a density higher than that in a conventional multicore flat cable wherein core wires are arrayed at a pitch of 1.27 mm. An example thereof is a multicore flat cable in which core wires are arrayed at a pitch of 0.635 mm. As a connector for connecting such microminiaturized multicore flat cable at the pitch of 0.635 mm, there has been developed, for example, a press-connecting type electric connector for a multicore flat cable as disclosed in the Official Gazette of Japanese patent application Pulication No. 57-53629. The press-connecting type electric connector for a multicore flat cable is such that a plurality of press-connecting type contacts are arrayed in an insulating housing as two zigzag arrays, and that the arrayal pitches of all the contacts of the two arrays are previously equalized to the core wire arrayal pitch of the multicore flat cable to be connected, whereupon individual core wires at the end part of the multicore flat cable as are left intact are press-connected to the press-connecting portions of these contacts.

The prior-art press-connecting type electric connector for a multicore flat cable as stated before is effective in that the size of the press-connecting portion of each contact can be made comparatively large because, even when the arrayal pitch of the core wires of the multicore flat cable to be connected is 0.635 mm by way of example, the arrayal pitch of the contacts of the respective arrays arranged in the insulating housing may be double or 1.27 mm. With such structure of the prior-art electric connector, however, the arrayal pitch itself of the core wires of the multicore flat cable to be connected cannot be freely changed. For example, the contacts of the electric connector at an arrayal pitch of 1.27 mm must be ordinarily press-connected to the respective core wires arrayed at the same pitch of 1.27 mm, and those at an arrayal pitch of 0.635 mm must be ordinarily press-connected to the respective core wires arrayed at the same pitch of 0.635 mm. Accordingly, problems such as erroneous connection will be prone to occur unless the machining precision of the contacts themselves, the precision of the arrayal pitch of the contacts and the precision of the core wire arrayal pitch of the flat cable are rendered higher for the high density multicore flat cable of smaller core wire arrayal pitch.

Moreover, raising these precisions is subjected to mechanical limitations, and in case of connecting a multicore flat cable of higher density, the pitch between the contacts and the pitch between the core wires of the cable are very small and the core wires are fine. Therefore, inferior connecting or an unstable connection has been caused by a slight pitch discrepancy of the press-connecting, to inevitably spoil the mass-producibility and the reliability.

An object of the present invention is to provied a method of press-connecting a multicore flat cable and an electric connector for a multicore flat cable which can eliminate the problems of the prior art as described above.

SUMMARY OF THE INVENTION

According to an aspect of this invention, there is provided a method of press-connecting core wires of a multicore flat cable to press-connecting type contacts of an electric connector comprising the steps of disjointing the core wires from one another over a predetermined length at an intermediate part of the multicore flat cable to be connected and winding the disjointed core wires around a cable wiring member of the electric connector at intervals corresponding to an arrayal pitch of the press-connecting type contacts which are disposed in the electric connector, and press-connecting the respective press-connecting type contacts to parts of the corresponding core wires wound on one surface of the cable wiring member.

According to another aspect of this invention there is provided an electric connector for a multicore flat cable characterized by comprising an insulating housing which has a contact arrayal surface with a plurality of press-connecting type contacts disposed at a predetermined pitch so as to protrude their press-connecting portions therefrom, and a cable wiring member which is assembled to said contact arrayal surface of the insulating housing; the cable wiring member being provided with a plurality of core wire laying slots which are formed along a periphery thereof at intervals corresponding to the predetermined pitch, and a plurality of press-connecting portion-receiving flutes which are formed so as to traverse the respective core wire laying slots and which receive the press-connecting portions of the respective contacts; each core wire laying slot receiving the corresponding one of core wires disjointed at an intermediate part of the multicore flat cable so that the corresponding core wire may surround the cable wiring member.

According to still another aspect of this invention there is porvided an electric connector for a multicore flat cable characterized by comprising an insulating housing which has a contact arrayal surface with a plurality of press-connecting type contacts disposed in at least two arrays and at a predetermined pitch so as to protrude their press-connecting portions therefrom, and at least two cable wiring members which are assembled to the contact arrayal surface of the insulating housing and in correspondence with the respective arrays; each cable wiring member being provided with a plurality of core wire laying slots which are formed along a periphery thereof at intervals corresponding to the contact arrayal pitch of the corresponding array, and a plurality of press-connecting portion-receiving flutes which are formed so as to traverse the respective core wire laying slots and which receive the press-connecting portions of the respective contacts; each core wire laying slot receiving one core wire of a corresponding group among core wires disjointed at an intermediate poart of the muticore flat cable so that the one core wire may surround said cable wiring member; the respective cable wiring members being coupled to each other in a state in which the respective core wires are wound and disposed in the corresponding core wire laying slots.

The present invention will be described more in detail in conjunction with embodiments thereof with reference to the accompanying drawings.

DESCRIPTION OF THE PREFERRED EMBODIMENTS

Figure 1:
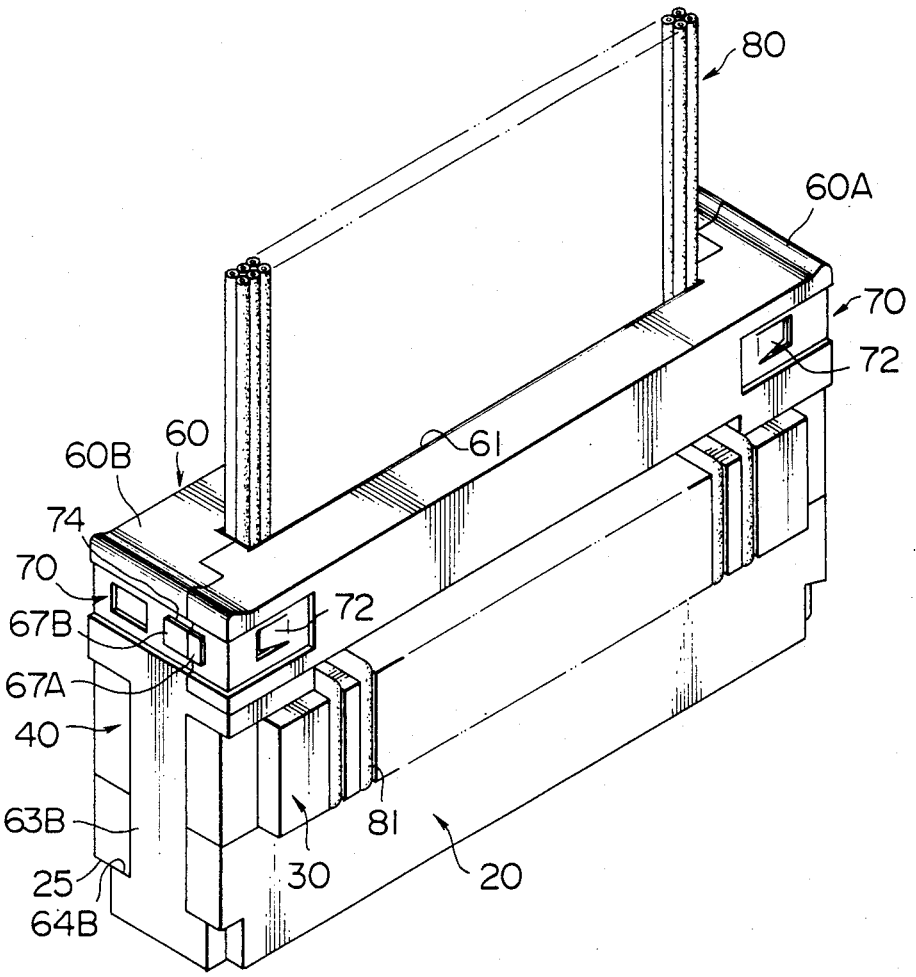
FIG. 1 is a perspective view showing the connected and assembled state of an electric connector for a multicore flat cable as an embodiment of the present invention.

FIG. 1 shows in perspective the connected and assembled state of an electric connector for a multicore flat cable which is one embodiment of the present invention. This electric connector for a multicore flat cable principally comprises an insulating housing 20 in which press-connecting type contacts are disposed, two cable wiring members 30 and 40, and a cable fixing member 60.

Figure 2:
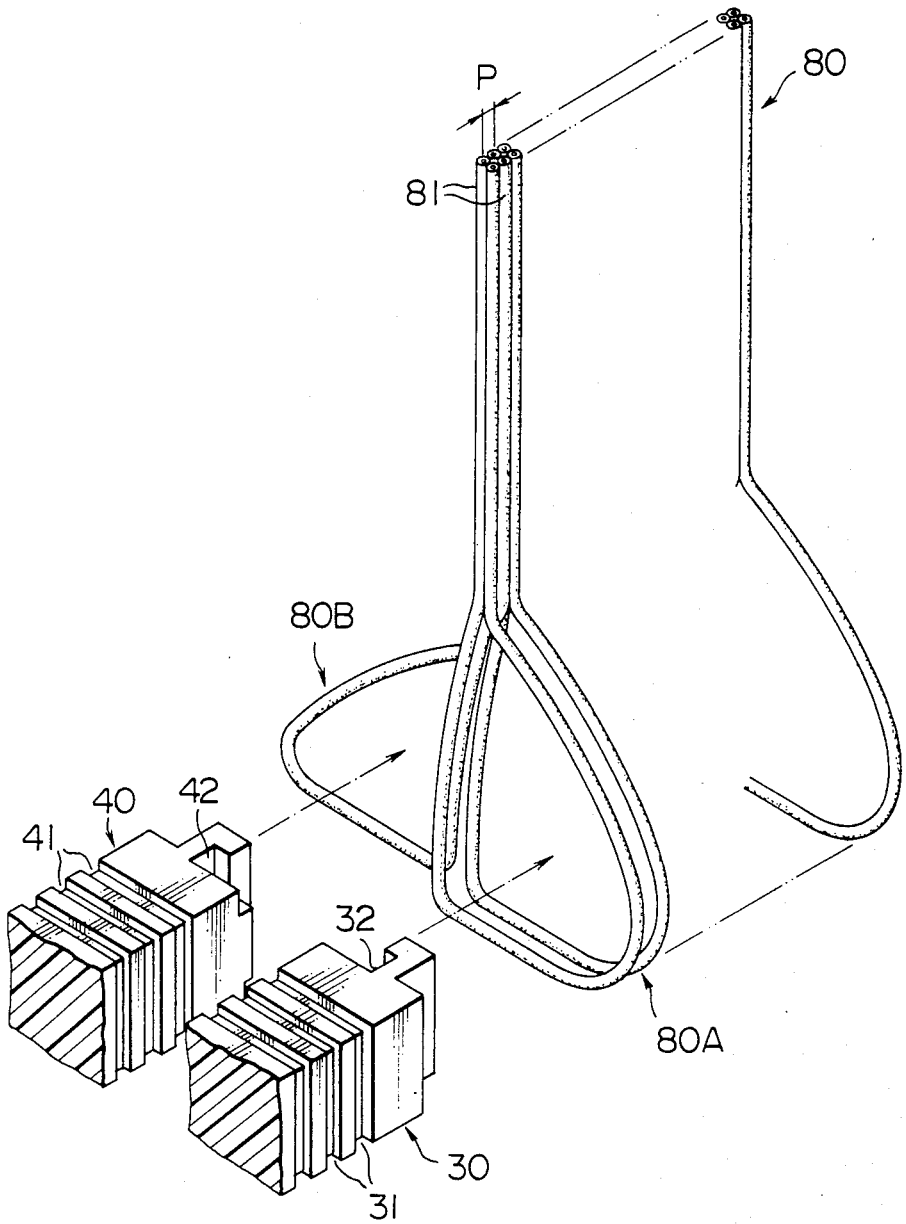
FIGS. 2 and 3 are views for explaining a method of splicing the multicore flat cable to the electric connector in FIG. 1.
Figure 3:
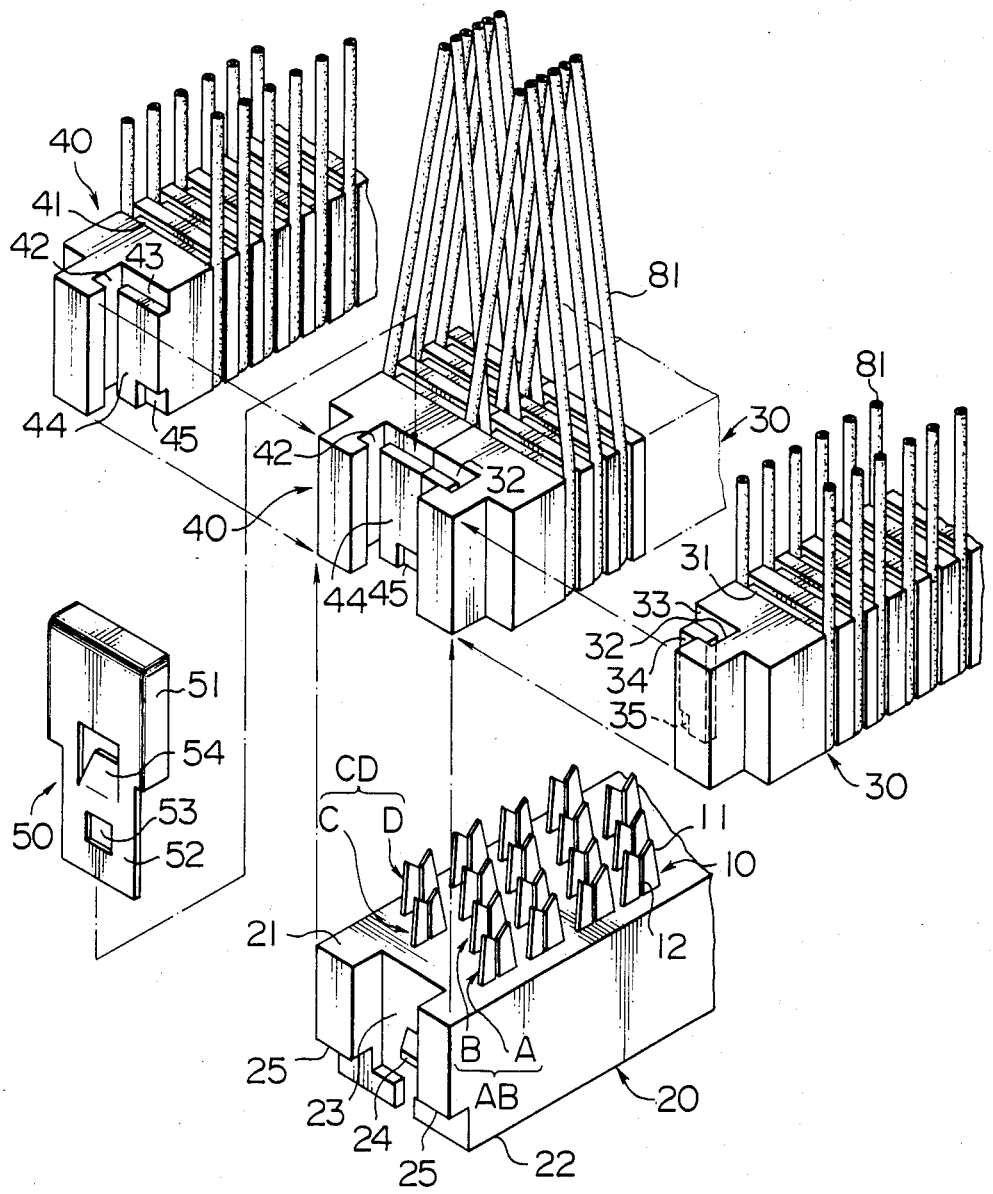
Figure 4:
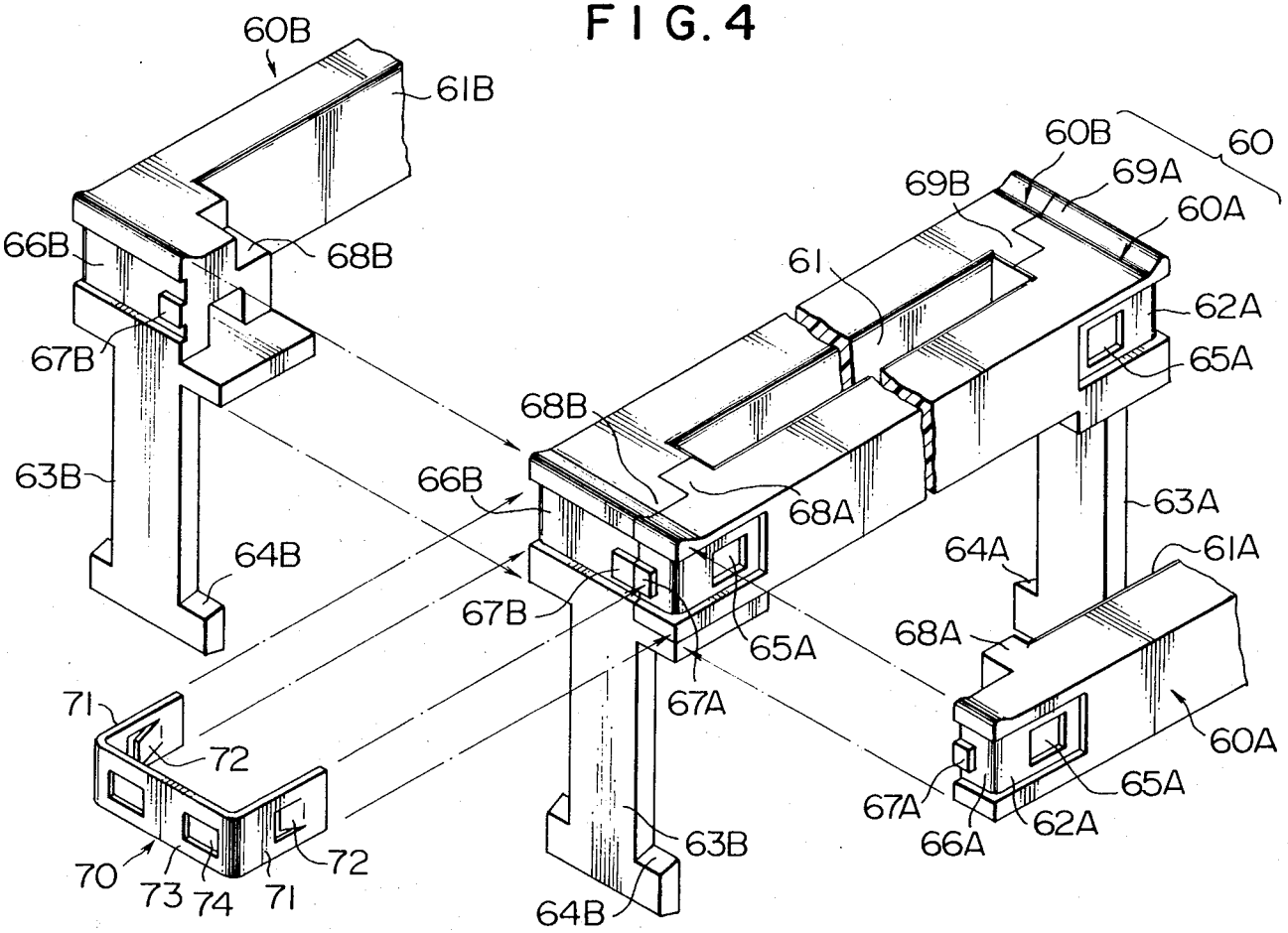
FIG. 4 is a view showing the details of the cable fixing member of the electric connector in FIG. 1.

FIGS. 2 and 3 are views for explaining a method of connecting the multicore flat cable 80 to the electric connector in FIG. 1, wherein FIG. 2 is a partial perspective view showing the state just before the respective cable wiring members 30 and 40 are inserted into the two groups of core wire loops 80A and 80B of the multicore flat cable 80 handled as will be described later, while FIG. 3 is a partial perspective view showing the state before the cable wiring members 30 and 40 mounted in the core wire loop groups 80A and 80B respectively and combined with each other are assembled to the insulating housing 20. FIG. 4 shows the details of the cable fixing member 60.

Referring particularly to FIGS. 2 thru 4, the details of the structure of the electrical connector of the embodiment in FIG. 1 and the method of connecting the multicore flat cable thereto will now be described.

First, as partially shown in FIG. 3, the insulating housing 20 is unitarily molded of an insulating material such as plastic material and has a contact arrayal face 21 being substantially flat. This insulating housing 20 is provided with two zigzag arrays each consisting of a plurality of contact arrayal holes (not shown) which penetrate it from the contact arrayal face 21 to an end face 22 opposite thereto. Further, both the side surfaces of the insulating housing 20 are formed with guide grooves 23 for receiving cable wiring member-fixtures 50 to be described later and the engaging legs 63A and 63B of the cable fixing member 60. The bottom wall of each guide groove 23 is formed substantially centrally with a suspending protrusion 24 which serves to engagedly fix the insulating housing 20 and the cable wiring members 30 and 40 in fit engagement with the engaging hole 53 of the engaging leg 52 of the cable wiring member-fixture 50. Besides, the lower parts of both the side walls of the guide groove 23 are provided with suspending steps 25 which serve to engagedly fix the insulating housing 20 and the cable fixing member 60 in fit engagement with engaging shoulders 64A or 64B provided in the corresponding engaging leg 63A or 63B of the cable fixing member 60.

Each of the press-connecting type contacts 10 has a press-connecting portion 11, and a contact portion (not shown) for contact with a mating contact. The press-connecting portion 11 is formed with a slit 12 for press-connecting the core wire of the multicore flat cable to be connected.

As clearly shown in FIG. 3, the respective contacts 10 are disposed in the insulating housing 20 in the state in which their contact portions are inserted into the corresponding contact arrayal holes of the insulating housing 20 and in which their press-connecting portions 11 are protruded beyond the contact arrayal face 21. In this embodiment, the contacts which are disposed along a line indicated by reference symbol A and a line indicated by reference symbol C are in alignment with each other, and they are arrayed at an arrayal pitch being four times the arrayal pitch P (refer to FIG. 2) of the core wires 81 of the multicore flat cable 80 to be connected, namely, at an arrayal pitch of 4P. On the other hand, the contacts 10 which are disposed along lines indicated by reference symbols B and D are in alignment with each other but are shifted relative to the contacts of the lines A and C by a pitch of half of the arrayal pitch 4P of these contacts, namely, by a pitch of 2P, and they are arrayed at an arrayal pitch of 4P. The contacts of the line A and those of the line B constitute a contact array AB, while the contacts of the line C and those of the line D consititute another contact array CD. Accordingly, the contacts of the contact array AB are arranged at an arrayal pitch of 2P though in the zigzag arrayal, and also the contacts of the contact array CD are arranged at an arrayal pitch of 2P though in the zigzag arrayal.

As partially shown clearly in FIG. 3, the cable wiring member 30 is formed substantially in the shape of a rectangle by the use of an insulating material such as plastics. This cable wiring member 30 is formed with a plurality of core wire laying slots 31 in the form of closed loops at intervals and along the perimeter thereof. In this embodiment, the arrayal pitch of the core wire laying slots 31 is set at double the arrayal pitch P of the core wires of the multicore flat cable 80 to be connected, namely, at 2P. In addition, the lower surface of the cable wiring member 30 is formed with a plurality of press-connecting receiving flutes 31A (refer to FIG. 5) so as to traverse the respective core wire laying slots 31 at positions where they receive the press-connecting portions 11 of the contacts 10 of the contact array AB disposed in the insulating housing 20. Further, both the side surfaces of the cable wiring member 30 are formed with hook-shaped grooves 32 which have openings at positions where they correspond to the openings of hook-shaped grooves 42 provided in both the side surfaces of the cable wiring member 40 to be described below. Besides, the bottom wall 33 of each hook-shaped groove 32 is provided with a fixing protuberance 34 which has an engaging recess 35 at its lower part.

Since the other cable wiring member 40 has substantially the same configuration as that of the cable wiring member 30 stated above, it shall not be described in detail. As clearly shown in FIG. 3, however, the cable wiring members 30 and that 40 confront each other so when their side surfaces are joined together in direct, opposed engagement as shown in FIG. 3, the hook-shaped grooves 32 and 42 in both their side surfaces may form grooves which permit the cable wiring member-fixtures 50 to be inserted from above. Reference numeral 41 indicates a core wire laying slot similar to the core wire laying slot 31, reference numeral 43 a bottom wall similar to the bottom wall 33, reference numeral 44 a fixing protuberance similar to the fixing protuberance 34, and reference numeral 45 an engaging recess similar to the engaging recess 35.

As clearly shown in FIG. 3, each of the cable wiring member-fixtures 50 for joining and fixing (securing) the cable wiring members 30 and 40 is punched from a flat metal material or the like and is formed by press work. The cable wiring member-fixture is formed at its upper part with a protuberance receiving portion 51 whose cross section is substantially in the shape of a channel, and at its lower part with the engaging leg 52 which has the engaging hole 53. In addition, the central part of the fixture 50 is formed with an engaging tongue 54 which is snapped by spring elasticity into the engaging recesses 35 and 45 of the fixing protuberances 34 and 44 provided on both the sides of the cable wiring members 30 and 40.

FIG. 4 shows partially the state in which the components of the cable fixing member 60 are disassembled, and shows in perspective the state in which the main components are assembled. As shown in FIG. 4, the cable fixing member 60 is composed of a first cable fixing member 60A, a second cable fixing member 60B and a pair of fixtures 70. Since the first cable fixing member 60A and the second cable fixing member 60B have the same shapes in plane symmetry so as to be combined with each other, it is intended to describe the structures of the respective members 60A and 60B by describing the structures of only part of the first cable fixing member 60A and part of the second cable fixing member 60B. One side surface of the first cable fixing member 60A is formed with a recess 61A which serves to define an opening 61 for passing the folded-up part of the multicore flat cable 80, the opposite side surface is formed near both its ends with grooves 62A which receive the legs 71 of the fixtures 70, and the bottom wall of each groove 62A is provided with an engaging recess 65 A with which an engaging tongue 72 formed in the leg 71 of the fixture 70 is brought into fit engagement. Further, both the end faces of the first cable fixing member are formed with grooves 66A which receive the yoke portions 73 of the fixtures 70, and a fit engaging prominence 67A which fits in the fit engaging aperture 74 of the fixture 70 is provided in each groove 66A. Besides, both the ends of one side surface of the first cable fixing member 60A are formed with pairing shape portions 68A and 69A for pairing with the second cable fixing member 60B, the right end of the first cable fixing member 60A as viewed in FIG. 4 is provided with the engaging leg 63A extending downwards, and both the sides of the lower end of the engaging leg 63A are provided with the engaging shoulders 64A.

Likewise, one side surface of the second cable fixing member 60B is formed with a recess 61B for defining the opening 61, and the opposite side surface is provided near both its ends with grooves and engaging recesses (not seen in the figure) similar to the grooves 62A and the engaging recesses 65A in the first cable fixing member 60A. Further, grooves 66B which receive the yoke portions 73 of the fixtures 70 are formed at both the end faces of the second cable fixing member, and a fit engaging prominence 67B which fits in the fit engaging aperture 74 of the fixture 70 is provided in each groove 66B. Besides, both the ends of one side surface of the second cable fixing member 60B are formed with pairing shape portions 68B and 69B of complementary shapes adapted to pair with the pairing shape portions 68A and 69A of the first cable fixing member 60A, the left end of the second cable fixing member 60B as viewed in FIG. 4 is provided with the engaging leg 63B extending downwards, and both the sides of the lower end of the engaging leg 63B are provided with the engaging shoulders 64B.

One example of procedure for connecting the multicore flat cable 80 to the electric connector of such construction will now be described.

(1) First, as shown in FIG. 2, the core wires 81 at the intermediate part of the multicore flat cable 80 are disjointed one by one over a predetermined length. In this case, a cable whose intermediate part as predetermined is disjointed as a reed-screen multicore cable may well be used from the beginning. The disjointed core wires are turned by 180°, and the adjoining closed core wire loops are portioned out rightwards and leftwards, to form the two groups of core wire loops 80A and 80B.

(2) Next, the cable wiring members 30 and 40 are respectively inserted into the closed loops of the core wire loop groups 80A and 80B portioned out rightwards and leftwards, and the individual core wires 81 are arranged so as to be wound in the respective core wire laying slots 31 and 41 of the cable wiring members 30 and 40 (refer to FIG. 3).

(3) Subsequently, the cable wiring members 30 and 40 are combined, and the cable wiring member-fixtures 50 are inserted from above the hook-shaped grooves 32 and 42, thereby to join and fix the cable wiring members 30 and 40 in direct engagement with each other.

(4) Next, the insulating housing 20 in which the contacts 10 are disposed as shown in FIG. 3 is set under the joined and fixed cable wiring members 30 and 40, and these cable wiring members 30 and 40 are lowered with a proper jig for press-connecting (now shown), thereby to press-connect the core wires 81 to the press-connecting portions 11 of the contactors 10. At this time, the press-connecting portions 11 of the respective contacts 10 enter the corresponding press-connecting portion-receiving flutes 31A and 41A which are formed in the lower surfaces of the cable wiring members 30 and 40 (refer to FIG. 5). In this case, the engaging holes 53 of the fixtures 50 are brought into engagement with the suspending protrusions 24 of the insulating housing 20, whereby the cable wiring members 30 and 40 and the insulating housing are fixed.

(5) Next, the first cable fixing member 60A and the second cable fixing member 60B shown in FIG. 4 are joined to sandwich the superposed part of the cable 80, and they are lowered from above the cable wiring members 30 and 40, thereby to insert the engaging legs 63A and 63B of the cable fixing members 60A and 60B into the guide grooves 23 of the insulating housing 20, and to suspend and fasten the engaging shoulders 64A and 64B of the engaging legs 63A and 63B on the suspending steps 25 of the guide grooves 23.

(6) Lastly, the fixtures 70 are inserted in the joined cable fixing members 60A and 60B so as to reliably hold the cable 80 by means of the cable fixing member 60. This state is illustrated in FIG. 1.

Figure 5:
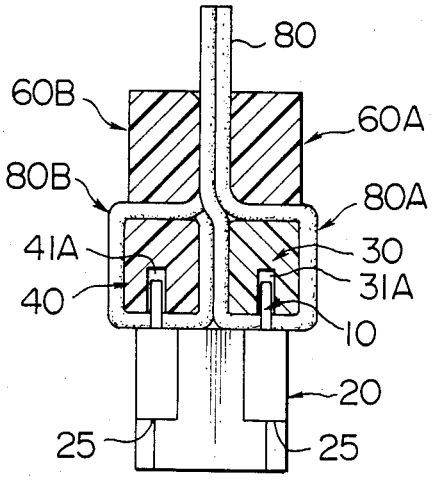
FIG. 5 is a sectional view showing the spliced state of the electric connector in FIG. 1.
Figure 6:
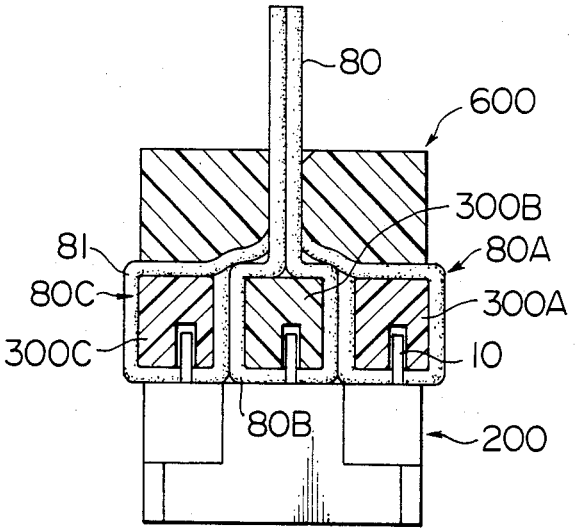
FIG. 6 is a sectional view similar to FIG. 5, showing another embodiment of the present invention.

FIG. 6 is a view similar to FIG. 5, showing the connected state of an electric connector which is another embodiment of the present invention. In the electric connector of this embodiment, contacts 10 are disposed as three zigzag arrays in an insulating housing 200, and three cable fixing members 300A, 300B and 300C are coupled on the insulating housing 200. The insulating housing 200 with the cable fixing members 300A, 300B and 300C and a cable 80 are unitarily held by a cable fixing member 600. The detailed structures of the insulating housing 200, the cable wiring members 300A, 300B and 300C and the cable fixing member 600 may be almost similar to those of the insulating housing 20, the cable wiring members 30 and 40 and the cable fixing member 60 in the electric connector of the foregoing embodiment, and they shall not be repeatedly explained. In case of connecting the cable 80 to the electric connector of the embodiment in FIG. 6, however, core wires 81 at the intermediate part of the multicore flat cable 80 are disjointed one by one over a predetermined length, the disjointed core wires are turned by 180°, and the adjoining core wire loops are successively portioned out rightwards, centrally and leftwards, to form three groups of core wire loops 80A, 80B and 80C. Accordingly, the core wire arrayal pitch of each group becomes 3P where P denotes the ordinary arrayal pitch of the cable 80. Therefore, the arrayal pitch of core wire laying slots which are formed in each cable wiring member 300A, 300B or 300C needs to be correspondingly set 3P beforehand, and also the arrayal pitch of the contacts of each array which are arranged in the insulating housing 200 needs to be set at 3P.

While, in the foregoing two embodiments, the two or three cable wiring members have been employed, the present invention is not restricted thereto, but four or more cable wiring members can be employed or only one cable wiring member can be employed. Further, while in the foregoing embodiments the arrayal pitch of the core wire laying slots which are formed in the cable wiring members and the arrayal pitch of the contacts which are disposed in the insulating housing have been 2P or 3P in conformity with the ordinary core wire arrayal pitch P of the multicore cable to be connected, the present invention is not restricted thereto, but the arrayal pitch of the core wire laying slots and that of the contacts may well be set at will irrespective of the ordinary core wire arrayal pitch of the multicore cable to be connected.

As apparent from the foregoing, according to the present invention, the following effects are attained:

(1) Since the core wires of a multicore flat cable are disjointed one by one and are laid in the core wire laying slots of cable wiring members to be thereafter press-connected, the precision of the pitch of contacts need not be raised and the precision of the pitch between the core wires of the multicore cable need not be raised, either, so that an inexpensive electric connector and an inexpensive multicore cable can be provided.

(2) Even when the ordinary pitch (arrayal pitch) between the core wires of a multicore flat cable is small and the conductor diameter of the core wires is small, the contact arrayal pitch of an electric connector can be freely selected, so that contacts with press-connecting portions and an insulating housing, the precisions of which are to the extent of having heretofore been attainable, can be used, and that an electric connector of high reliability can be provided at high mass-producibility.

(3) In case of disposing a plurality of cable wiring members, the core wires of a cable are disjointed and are dispersedly laid in the core wire laying slots of the plurality of cable wiring members, whereby a connector can be made the shortest in the lengthwise direction thereof and can be reduced in the widthwise direction thereof. Alternatively, the arrayal pitch of contacts can be more enlarged, so that an electric connector of high performance can be provided at lower cost.

We claim:

1. An electrical connector for a multicore flat cable having a number of core wires comprising: an insulating housing having a top surface; a plurality of contacts each having press-connecting portions and disposed in said insulating housing so that said press-connecting portions protrude beyond the top surface of said insulating housing and are arrayed at predetermined pitches in at least three rows; at least two cable wiring members, one for each of corresponding ones of the rows of said press-connecting portions, each cable wiring member being provided with a plurality of core wire laying slots which are formed along a periphery thereof at intervals corresponding to the predetermined pitch of the corresponding row of said press-connecting portions; a plurality of press-connecting portion-receiving flutes which are formed so as to traverse the respective core wire laying slots and which receive the press-connecting portions of respective ones of the contacts; and means for securing said cable wiring members together in closely adjacent, directly opposed relationship and so that the press-connecting portion-receiving flutes of said cable wiring members are open downward, with portions of the core wires of said multicore flat cable being separated from one another at an intermediate portion thereof, shaped into the form of loops and divided into at least two core wire loop groups, and with the loop-like core wire portions of said core wire loop groups surrounding the corresponding cable wiring members so as to be disposed in the corresponding core wire laying slots of the cable wiring members, and wherein said cable wiring members, secured together by said securing means, are coupled to said top surface of said insulating housing to make press-connection of each core wire with the corresponding press-connecting portion of a respective one of said contacts.

2. An electrical connector for a cable having a number of core wires comprising: an insulating housing having a mounting surface; a pluralty of contacts each having press-connecting portions and disposed in said insulating housing so that said press-connecting portions protrude beyond the mounting surface of said insulating housing and are arrayed at predetermined pitches in at least three rows; at least three cable wiring members, one for each of the rows of said press-connecting portions, each cable wiring member being provided with a plurality of core wire laying slots which are formed in a periphery thereof at intervals corresponding to the predetermined pitch of the corresponding row of said press-connecting portions, for receiving at least portions of intermediate loop portions of the core wires of the cable when the loop portions are positioned in surrounding relationship around corresponding ones of the cable wiring members; each cable wiring member also including a plurality of press-connecting portion-receiving flutes which are formed to receive the press-connecting portions of the respective contacts; and means for securing said cable wiring members to each other in closely adjacent, directly opposed relationship after the core wire loop portions have been positioned around the cable wiring members, said secured cable wiring members being positionable on said mounting surface of said insulating housing with said press-connecting portions of said contacts received in said flutes and press-connected to respective ones of said core wires.

* * * * *